US007681966B2

(12) United States Patent
Parker et al.

(10) Patent No.: US 7,681,966 B2
(45) Date of Patent: Mar. 23, 2010

(54) PRINTING PROCESS

(75) Inventors: Leonard A. Parker, Pittsford, NY (US); Jennifer L. Belelie, Oakville (CA); Peter G. Odell, Mississauga (CA); Paul Farrell Smith, Oakville (CA)

(73) Assignee: Xerox Corporation, Norwalk, CT (US)

( * ) Notice: Subject to any disclaimer, the term of this patent is extended or adjusted under 35 U.S.C. 154(b) by 776 days.

(21) Appl. No.: 11/372,423

(22) Filed: Mar. 9, 2006

(65) Prior Publication Data

US 2007/0211128 A1 Sep. 13, 2007

(51) Int. Cl.

| | |
|---|---|
| ***B41J 29/38*** | (2006.01) |
| ***B41J 2/17*** | (2006.01) |
| ***B41J 2/175*** | (2006.01) |
| ***B41J 2/01*** | (2006.01) |

(52) U.S. Cl. ..... 347/6; 347/84; 347/88; 347/103

(58) Field of Classification Search ..... 347/88, 347/99, 84, 85, 95, 102, 103, 104, 5, 6
See application file for complete search history.

(56) References Cited

U.S. PATENT DOCUMENTS

| | | | | |
|---|---|---|---|---|
| 4,538,156 | A | 8/1985 | Durkee et al. | 346/21 |
| 5,389,958 | A | 2/1995 | Bui et al. | 347/103 |
| 5,502,476 | A | 3/1996 | Neal et al. | 347/103 |
| 5,554,212 | A * | 9/1996 | Bui et al. | 524/27 |
| 5,614,933 | A * | 3/1997 | Hindman et al. | 347/103 |
| 5,750,186 | A * | 5/1998 | Frazzitta | 427/8 |
| 5,777,650 | A | 7/1998 | Blank | 347/103 |
| 5,902,841 | A * | 5/1999 | Jaeger et al. | 523/161 |
| 6,099,631 | A * | 8/2000 | Tregub et al. | 106/31.85 |
| 6,196,675 | B1 | 3/2001 | Deily et al. | 347/103 |
| 6,427,597 | B1 * | 8/2002 | Aurenty et al. | 101/465 |
| 6,843,559 | B2 | 1/2005 | Pan et al. | 347/103 |
| 7,108,367 | B2 * | 9/2006 | Ushirogouchi et al. | 347/102 |
| 7,276,614 | B2 * | 10/2007 | Toma et al. | 554/37 |
| 7,293,868 | B2 * | 11/2007 | Odell et al. | 347/100 |
| 2007/0126833 | A1 * | 6/2007 | Laurin et al. | 347/102 |
| 2008/0038491 | A1 * | 2/2008 | Ikeda et al. | 428/32.25 |

FOREIGN PATENT DOCUMENTS

JP 2006103315 A * 4/2006

OTHER PUBLICATIONS

U.S. Appl. No. 11/289,473, filed Nov. 30, 2005, of Rina Carlini et al., entitled "Radiation Curable Phase Change Inks Containing Curable Epoxy-Polyamide Composite Gellants," 33 pages, not yet published.
U.S. Appl. No. 11/289,609, filed Nov. 30, 2005, of Peter G. Odell et al., entitled "Radiation Curable Phase Change Inks Containing Gellants," 26 pages, not yet published.
U.S. Appl. No. 11/290,098, filed Nov. 30, 2005, of Jennifer L. Belelie et al., entitled "Phase Change Inks Containing Curable Isocyanate-Derived Compounds and Phase Change Inducing Components," 90 pages, not yet published.
U.S. Appl. No. 11/290,122, filed Nov. 30, 2005, of Eniko Toma et al., entitled "Curable Amide Gellant Compounds," 89 pages, not yet published.
U.S. Appl. No. 11/291,315, filed Nov. 30, 2005, of Marcel P. Breton et al., entitled "Ink Carriers, Phase Change Inks Including Same and Methods for Making Same," 32 pages, not yet published.
U.S. Appl. No. 11/291,592, filed Nov. 30, 2005, of Adela Goredema et al., entitled "Phase Change Inks and Methods for making Same," 31 pages, not yet published.
U.S. Appl. No. 11/291,283, filed Nov. 30, 2005, of Marcel P. Breton et al., entitled "Black Inks and Method for Making Same," 25 pages, not yet published.

* cited by examiner

*Primary Examiner*—Stephen D Meier
*Assistant Examiner*—Leonard S Liang
(74) *Attorney, Agent, or Firm*—Marylou J. Lavoie, Esq.

(57) ABSTRACT

A process including selecting an ink having a viscosity that varies continuously over a range of transfuse process temperatures; forming an image on a preliminary receiving surface or on a final receiving substrate with the selected ink; providing a final receiving substrate at a selected temperature optionally comprising modifying the temperature of the final receiving substrate to achieve a selected temperature; optionally passing the final receiving substrate through a nip; optionally exerting pressure on the final receiving substrate in the nip to transfer the ink image from the preliminary receiving surface to the final receiving substrate; optionally fusing the ink image onto the final receiving substrate at a transfuse temperature; and controlling the viscosity of the ink during printing to match a selected characteristic of the final receiving substrate; and preserving the ink image.

10 Claims, No Drawings

PRINTING PROCESS

TECHNICAL FIELD

The present disclosure relates generally to an imaging process and more particularly relates in embodiments to an imaging process using a phase change ink.

RELATED APPLICATIONS

Commonly assigned, co-pending U.S. Patent Application of Rina Carlini et al., filed Nov. 30, 2005, Ser. No. 11,289,473, entitled "Radiation Curable Phase Change Inks Containing Curable Epoxy-Polyamide Composite Gellants," which is hereby incorporated by reference herein in its entirety, describes in the Abstract thereof a radiation curable phase change ink preferably used in piezoelectric ink jet devices includes an ink vehicle that includes at least one curable epoxy-polyamide gellant, and at least one colorant. The use of the gellant enables the ink to form a gel state having a viscosity of at least $10^3$ mPas at very low temperatures of about 25° C. to about 100° C. The ink may thus be jetted, for example onto an intermediate transfer member surface or directly to an image receiving substrate, at very low jetting temperatures of, for example, about 40° C. to about 110° C. In a preferred method of forming an image with the ink, the ink is heated to a first temperature at which the ink may be jetted, jetted onto an image receiving or intermediate transfer member surface maintained at a second temperature at which the ink forms a gel state, if appropriate subsequently transferred from the intermediate transfer member surface to an image receiving substrate, and exposed to radiation energy to cure the curable components of the ink.

Commonly assigned, co-pending U.S. Patent Application of Peter G. Odell et al., filed Nov. 30, 2005, Ser. No. 11,289,609, entitled "Radiation Curable Phase Change Inks Containing Gellants," which is hereby incorporated by reference herein in its entirety, describes in the Abstract thereof a radiation curable phase change ink preferably used in piezoelectric ink jet devices includes an ink vehicle that includes at least one gellant comprised of a curable polyamide-epoxy acrylate component and a polyamide component, and at least one colorant. The use of the gellant enables the ink to form a gel state having a viscosity of at least $10^3$ mPas at very low temperatures of about 25° C. to about 100° C. The ink may thus be jetted at very low jetting temperatures of, for example, about 40° C. to about 110° C. The ink may be used to from an image by heating the ink to a first temperature at which the ink may be jetted, jetting onto a member or substrate maintained at a second temperature at which the ink forms a gel state, and exposing the ink to radiation energy to polymerize curable components of the ink.

Commonly assigned, co-pending U.S. Patent Application of Jennifer L. Belelie et al., filed Nov. 30, 2005, Ser. No. 11,290,098, entitled "Phase Change Inks Containing Curable Isocyanate-Derived Compounds and Phase Change Inducing Components," which is hereby incorporated by reference herein in its entirety, describes in the Abstract thereof a phase change ink comprising a colorant, an initiator, and a phase change ink carrier, said carrier comprising (A) a compound which is the reaction product of a mixture comprising (1) an isocyanate; and (2) a component comprising (a) an alcohol having at least one ethylenic unsaturation; (b) an amine having at least one ethylenic unsaturation; (c) an acid having at least one ethylenic unsaturation; or (d) mixtures thereof, (B) a phase change inducing component, said phase change inducing component containing at least one hydroxyl group, said phase change inducing component having a melting point of about 40° C. or higher, and (C) an optional curable viscosity modifying ester, said ink being curable upon exposure to ultraviolet radiation.

Commonly assigned, co-pending U.S. Patent Application of Eniko Toma et al., filed Nov. 30, 2005, Ser. No. 11,290,122, entitled "Curable Amide Gellant Compounds," which is hereby incorporated by reference herein in its entirety, describes in the Abstract thereof a compound of the formula

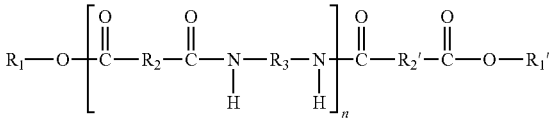

wherein $R_1$ and $R_{1'}$ each, independently of the other, is an alkyl group having at least one ethylenic unsaturation, an arylalkyl group having at least one ethylenic unsaturation, or an alkylaryl group having at least one ethylenic unsaturation, $R_2$, $R_{2'}$, and $R_3$ each, independently of the others, are alkylene groups, arylene groups, arylalkylene groups, or alkylarylene groups, and n is an integer representing the number of repeat amide units and is at least 1.

Commonly assigned, co-pending U.S. Patent Application of Marcel P. Breton et al., filed Nov. 30, 2005, Ser. No. 11,291,315, entitled "Ink Carriers, Phase Change Inks Including Same and Methods for Making Same," which is hereby incorporated by reference herein in its entirety, describes in the Abstract thereof an ink carrier comprising (A) an antioxidant mixture comprising (a) a hindered phenol antioxidant, and (b) a hindered amine antioxidant, (B) a polyalkylene wax, (C) a functional wax, and (D) an ester-terminated amide. The low polarity ink carrier is substantially resistant to phase separation, has excellent thermal stability, resists autocatalytic degradation of the ink composition and a substantial color shift upon standing, and provides enhanced humidity resistance. This ink carrier can be combined with a colorant to produce an ink composition.

Commonly assigned, co-pending U.S. Patent Application of Adela Goredema et al., filed Nov. 30, 2005, Ser. No. 11,291,592, entitled "Phase Change Inks and Methods for Making Same," which is hereby incorporated by reference herein in its entirety, describes in the Abstract thereof a phase change ink composition and a method for forming the ink composition. The phase change ink composition comprises (1) an ink carrier comprising (A) a first component which comprises a monoester wax or blend of monoesters having at least one alkyl group comprising at least 10 carbon atoms, and (B) a second component which comprises a polyalkylene wax, and (2) a urea gellant and (3) a colorant.

Commonly assigned, co-pending U.S. Patent Application of Marcel P. Breton et al., filed Nov. 30, 2005, Ser. No. 11,291,283, entitled "Black Inks and Method for Making Same," which is hereby incorporated by reference herein in its entirety, describes in the Abstract thereof a phase change black ink composition comprising (1) a low polarity ink carrier comprising (A) an ester-terminated polyamide, (B) a Guerbet alcohol or a Guerbet alcohol mixture including at least one linear alcohol, and (C) a low polarity wax, and (2) a black colorant. The ink carrier can also include a dispersant. The ink is resistant to aggregation and settling of the black colorant when a standby-mode printer temperature for the ink is not more than about the gel temperature of the ink.

The appropriate components and process aspects of the each of the foregoing U.S. patent applications may be selected for the present compositions and processes in embodiments thereof

BACKGROUND

Ink jet printing involves ejecting ink droplets from orifices in a print head onto a receiving surface to form an image. The image is made up of a grid-like pattern of potential drop locations, commonly referred to as pixels. The resolution of the image is expressed by the number of ink drops or dots per inch (dpi), with common resolutions being for example 300 dpi, 600 dpi, and 1200 dpi.

Ink jet printing systems commonly utilize either direct printing or offset printing architecture. In a typical direct printing system, ink is ejected from jets in the print head directly onto the final receiving substrate. In an offset printing system, the image is formed on an intermediate transfer surface and subsequently transferred to the final receiving substrate. The intermediate transfer surface may take the form of a liquid layer that is applied to a support surface, such as a drum. The print head jets the ink onto the intermediate transfer surface to form an ink image thereon. Once the ink image has been fully deposited, the final receiving substrate is then brought into contact with the intermediate transfer surface and the ink image is transferred to the final receiving substrate.

Ink jet printing systems using intermediate transfer, transfix or transfuse members are well known, such as those described in U.S. Pat. Nos. 4,538,156, 6,843,559, and 6,196,675, the disclosures of each of which are hereby each totally incorporated by reference herein in their entireties.

Generally, the intermediate transfer, transfix, or transfuse member (collectively referred to as intermediate transfer member hereinafter for simplicity) is employed in combination with a printhead. A final receiving surface or print medium is brought into contact with the imaging surface after the image has been placed thereon by the nozzles of the printhead. The image is then transferred and fixed to a final receiving surface.

More specifically, the phase change ink printing process begins by first applying a thin liquid, such as, for example, silicone oil, to an intermediate transfer member surface. The solid or hot melt ink is placed into a heated reservoir where it is maintained in a liquid state. This highly engineered ink is formulated to meet a number of constraints, including low viscosity at jetting temperatures, specific visco-elastic properties at component-to-media transfer temperatures, and high durability at room temperatures. Once within the printhead, the liquid ink flows through manifolds to be ejected from microscopic orifices such as through use of piezoelectric transducer (PZT) printhead orifices. The duration and amplitude of the electrical pulse applied to the PZT is controlled so that a repeatable and precise pressure pulse can be applied to the ink, resulting in the proper volume, velocity and trajectory of the droplet. Several rows of jets, for example four rows, can be used each one with a different color. The individual droplets of ink are jetted onto the liquid layer on the intermediate transfer member. The intermediate transfer member and liquid layer can be, if desired, held at a specified temperature such that the ink hardens to a ductile viscoelastic state.

After depositing the image, a print medium can, if desired, be heated by feeding it through a preheater and into a nip formed between the intermediate transfer member and a pressure member, either or both of which can also be heated. A hard synthetic pressure member is placed against the intermediate transfer member in order to develop a high-pressure nip. As the intermediate transfer member rotates, the heated print medium is pulled through the nip and is pressed against the deposited ink image with the help of a pressure member, thereby transferring the ink to the print medium. The pressure member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the intermediate transfer member and direct it into a media exit path.

To optimize image resolution, it is desirable that the transferred ink drops spread out to cover a predetermined area, but not so much that image resolution is compromised or lost. Finally, image transfer conditions desirably are such that nearly all the ink drops are transferred from the intermediate transfer member to the print medium. Therefore, it is desirable that the intermediate transfer member has the ability to transfer the image to the media sufficiently.

The intermediate transfer member can be multi-functional. First, the ink jet printhead prints images on the intermediate transfer member, and thus, it is a print medium. Second, after the images are printed on the intermediate transfer member, they can then be transfixed or transfused to a final print medium. Therefore, the intermediate transfer member provides a transfix or transfuse function, in addition to an image receiving function.

In order to ensure proper transfer and fusing of the ink off the intermediate transfer member to the print medium, certain nip temperature, pressure and compliance are selected. Unlike laser printer imaging technology in which solid fills are produced by sheets of toner, the solid ink is placed on the intermediate transfer member one pixel at a time and the individual pixels spread out during the transfix process to achieve a uniform solid fill. Also, the secondary color pixels on the intermediate transfer member are physically taller than the primary color pixels because the secondary pixels are produced from two primary pixels. Therefore, compliance in the nip enables conformity around the secondary pixels and allows the primary pixel neighbors to touch the final print medium with enough pressure to spread and transfer. The correct amount of temperature, pressure and compliance is selected to produce acceptable image quality.

U.S. Pat. No. 5,389,958 entitled "Imaging Process" which is hereby totally incorporated by reference herein in its entirety, is an example of an indirect or offset printing architecture that utilizes phase change ink. The intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of medium, is then fed into the transfer nip and the ink image is transferred to the final receiving substrate.

To provide acceptable image transfer and final image quality, an appropriate combination of pressure and temperature is applied to the ink image on the final receiving substrate. Reference, for example, U.S. Pat. No. 5,777,650 entitled "Pressure Roller" which is hereby incorporated by reference herein in its entirety, which discloses a roller for fixing an ink image on a final receiving substrate.

In a color printing system, the ink image on the final receiving surface is composed of individual drops of ink that form primary and secondary colors. The primary and/or secondary colors may include two or more drops of ink placed on top of one another. In the image transfer process, the ink image is transferred from the intermediate transfer member to the final receiving substrate. A portion of the ink image is fused or pressed into the final receiving substrate. The height of the remaining ink that lies above the surface of the final receiving substrate is referred to as the "ink pile height."

Piezoelectric ink jetting (PIJ) can be made by building a print image on an intermediate transfer member. The viscosity of the image desirably is greatly increased after jetting to obtain a stable, transfusable, and fusable image. Phase change inks can be used in this architecture. Another option for this type of architecture comprises printing directly onto paper.

The disclosures of each of the foregoing U.S. Patents and applications are hereby incorporated by reference herein in their entireties. The appropriate components and process aspects of the each of the foregoing U.S. Patents and applications may be selected for the present compositions and processes in embodiments thereof.

SUMMARY

Aspects illustrated herein include a process comprising selecting an ink having a viscosity that varies continuously over a range of transfuse process temperatures; forming an image on a preliminary receiving surface or on a final receiving substrate with the selected ink; providing a final receiving substrate at a selected temperature optionally comprising modifying the temperature of the final receiving substrate to achieve a selected temperature; optionally passing the final receiving substrate through a nip; optionally exerting pressure on the final receiving substrate in the nip to transfer the ink image from the preliminary receiving surface to the final receiving substrate; optionally fusing the ink image onto the final receiving substrate at a transfuse temperature; and controlling the viscosity of the ink during printing to match a selected characteristic of the final receiving substrate; and preserving the ink image.

Further aspects illustrated herein include a process comprising selecting an ink having a viscosity that varies continuously over a range of transfuse process temperatures; forming an image on a preliminary receiving surface with the selected ink; providing a final receiving substrate at a selected temperature optionally comprising modifying the temperature of the final receiving substrate to achieve a selected temperature; optionally passing the final receiving substrate through a nip; transferring the final ink image to the final receiving substrate optionally including exerting pressure on the final receiving substrate in the nip to transfer the ink image from the preliminary receiving surface to the final receiving substrate; optionally fusing the ink image onto the final receiving substrate at a transfuse temperature; controlling the viscosity of the ink during printing to match a selected characteristic of the final receiving substrate; and preserving the ink image.

Further aspects illustrated herein include a process comprising selecting an ink having a viscosity that varies continuously over a range of transfuse process temperatures; providing a final receiving substrate at a selected temperature optionally including modifying the temperature of the final receiving substrate to achieve a selected temperature; forming an image on the final receiving substrate with the selected ink; optionally passing the final receiving substrate through a nip; optionally fusing the ink image onto the final receiving substrate at a transfuse temperature; controlling the viscosity of the ink during printing to match a selected characteristic of the final receiving substrate; and preserving the ink image.

These and other features and advantages illustrated herein will be more fully understood from the following description of certain specific embodiments of the disclosure taken together with the accompanying claims.

DESCRIPTION

The term "phase change ink" means that the ink can change phases, such as a solid ink becoming liquid ink or changing from a solid into a more malleable state. Specifically, in embodiments, the ink can be in solid form initially, and then can be changed to a molten state by the application of heat energy. For example, the solid ink may be solid at room temperature, or at about 25° C. The solid ink may possess in embodiments the ability to melt at relatively high temperatures for example temperatures above from about 70° C. to about 150° C. The ink is melted at a high temperature and then the melted ink is ejected from a printhead onto the liquid layer of an imaging member. The ink is then cooled to an intermediate temperature of, for example, from about 20° C. to about 80° C. and solidifies into a malleable state in which it can be transferred onto a final receiving substrate or print medium.

Provided herein is an imaging method using phase change inks which change viscosity from a first lower viscosity to a second higher viscosity on the printing medium, for example a final receiving substrate such as paper, thereby preventing drop spread. The concept enables printing on various media types. The viscosity of the ink is adjustable on the media, such as by using different media preheat temperatures thus enabling image quality to be determined by the media chosen. The concept further enables the print quality to be optimized uniquely for specific media selected by the user.

Current phase change inks are jetted at from about 5 to about 30 centipoise (cps), or from about 8 cps to about 20 cps, or from about 10 cps to about 15 cps at about 140° C. and undergo a phase change at a temperature lower than the jetting temperature. The phase change is used to adjust the viscosity of the ink on the transfer drum. In a direct to print medium architecture, the present process uses the phase change to adjust print viscosity and hence control dot spread on the medium that is being printed on.

Printing processes illustrated herein include selecting an ink having a viscosity that varies continuously over the range of transfuse process temperatures; forming an image on a preliminary receiving surface or on a final receiving substrate with the selected ink; controlling the temperature of a final receiving substrate; optionally passing the final receiving substrate through a nip; optionally exerting a pressure on the final receiving substrate in the nip to transfer the ink image from the preliminary receiving surface to the final receiving substrate; optionally exerting a pressure on the final receiving substrate in the nip to increase the area of individual ink pixels that have been jetted directly on the final receiving substrate; optionally fusing the ink image onto the final receiving substrate at a transfuse temperature; controlling the viscosity of the ink during printing to match a selected characteristic of the final receiving substrate; and preserving the ink image.

In embodiments, the process comprises preserving the final ink image morphology. For example, after the temperature driven change in image attributes is made, it can be rendered permanent by photocuring the ink. Preserving the image comprises, for example, curing the ink, for example, in embodiments, curing by light initiated polymerization, for example, radical or cationic polymerization, to preserve, or make permanent, the selected characteristic in the final image. The curing of the ink renders the change in image properties permanent and is accomplished, in various exemplary embodiments, for example, by exposure to radiation selected from ultraviolet, visible or electron beam wavelengths, optionally in the presence of photoinitiators, for example photoinitiators disposed within the ink formulation, to effect polymerization of substantially most of the ink components by polymerization, for example, radical polymerization, cationic polymerization, or a combination of both mechanisms.

Controlling the viscosity of the ink during printing comprises, for example, adjusting one or a combination of the temperature of the ink at jetting, the preheat temperature of the final receiving substrate, the heat transfer properties of the ink, the heat transfer properties of the final receiving substrate, the heat transfer properties of the preliminary receiving surface, the temperature of the preliminary receiving surface, the temperature of the ink, and the temperature of the final receiving substrate during image formation. The final receiving substrate may comprise any desired substrate, including, but not limited to, for example, paper, box board, cardboard, plastic film, metal, ceramic, textile, or the like, or a combination thereof.

In embodiments, the process comprises a solid ink jet (SIJ) printing process comprising using an ink formulation(s) that is free of (that is, does not have) a sharp phase change transition with a viscosity plateau at or near the transfuse temperature of the ink. That is, in a plot of viscosity versus temperature for selected ink embodiments, the curve would be smooth and gradual. For example, an ink formulation having a viscosity that varies continuously over the range of the transfuse process temperatures is selected. The selection of these inks enables the ability to adjust the printing medium (for example, paper) preheat temperature and the temperature of the preliminary receiving surface and further enables the ability to control the dot spread and impressing of the ink into various media. The process comprises controlling ink viscosity during printing to match the media.

The details of embodiments of phase-change ink printing processes are described in the patents referred to above, such as U.S. Pat. Nos. 5,502,476; 5,389,958; and 6,196,675 B1, the disclosures of each of which are hereby incorporated by reference in their entirety. Current phase change inks show a very sharp phase transition with a viscosity plateau at the drum temperature. This type of rheology does not allow the viscosity of the drop to be adjusted on the final receiving substrate. The rheology at about 70° C. remains constant, making media dependant viscosity changes impossible.

EXAMPLES

In embodiments, inks suitable for selection for the present process include but are not limited to those disclosed in commonly assigned, co-pending U.S. Patent applications of Rina Carlini et al., filed Nov. 30, 2005, Ser. No. 11,289,473, entitled "Radiation Curable Phase Change Inks Containing Curable Epoxy-Polyamide Composite Gellants," of Peter G. Odell et al., filed Nov. 30, 2005, Ser. No. 11,289,609, entitled "Radiation Curable Phase Change Inks Containing Gellants," of Jennifer L. Belelie et al., filed Nov. 30, 2005, Ser. No. 11,290,098, entitled "Phase Change Inks Containing Curable Isocyanate-Derived Compounds and Phase Change Inducing Components," of Eniko Toma et al., filed Nov. 30, 2005, Ser. No. 11,290,122, entitled "Curable Amide Gellant Compounds," of Marcel P. Breton et al., filed Nov. 30, 2005, Ser. No. 11,291,315, entitled "Ink Carriers, Phase Change Inks Including Same and Methods for Making Same," of Adela Goredema et al., filed Nov. 30, 2005, Ser. No. 11,291,592, entitled "Phase Change Inks and Methods for Making Same," and of Marcel P. Breton et al., filed Nov. 30, 2005, Ser. No. 11,291,283, entitled "Black Inks and Method for Making Same," each of which are hereby totally incorporated by reference herein.

Example 1

For example, an ink composition for the present process may be selected, in embodiments, from a radiation curable phase change ink containing an epoxy-polyamide composite gellant, as disclosed in U.S. Patent application of Rina Carini et al., file Nov. 30, 2005, Ser. No. 11,289,473 referenced above, comprising as follows.

A curable epoxy-polyamide composite gellant was prepared as follows. In a 200 ml round bottom flask equipped with reflux condenser, thermometer and addition funnel, was charged a bisphenol A-co-epichlorohydrin epoxy resin commercially available from Dow Chemical as DER 383 resin (11.25 g, or 45% by weight of total material), a polyamide resin VERSAMI) 335 available from Cognis Corp. (6.25 g, or 25% by weight), and triphenylphosphine as catalyst (0.0875 g, or 0.35% by weight). The mixture was heated to 90° C. and stirred for 1 hour, after which time was first added a prepared solution of acrylic acid (3.75 g, 15% by weight) and 4-methoxyphenol as polymerization inhibitor (0.0125 g, 0.05% by weight), followed with a second prepared solution containing lauric acid (1.0625 g, 4.25% by weight) and triphenylphosphine (0.0875 g, 0.35% by weight). The temperature of the reaction mixture was increased to 115° C. and stirred for an additional 3 hours, thereby forming the acrylate-modified epoxy-polyamide composite gellant. A reactive diluent was then added to the mixture, a propoxylated neopentyl glycol diacrylate diluent (NPPOGDA) available as SR 9003 from Sartomer Corp. (25 g, 10% by weight) while gradually cooling the mixture down. The product was obtained as a clear, pale yellow gelatinous material with a yield of 45.8 grams. $^1$H-NMR spectroscopic analysis (300 MHz, $CDCl_3$) of this material shows the presence of a new set of acrylate hydrogens that differed in chemical shift from those of acrylic acid, and did not clearly reveal the presence of any unreacted epoxy-group hydrogens.

Curable Ink

A radiation-curable ink composition was prepared using the gellant of Example 1 except that no reactive diluent was used in preparation. The gellant material (12 g) was first dissolved in propoxylated neopentylglycol diacrylate (42.3 g), to which was added a mixture of photoinitiators consisting of 3 g 1-(4-(2-hydroxyethoxy)phenyl)-2-hydroxy-2-methylpropan-1-one, 3 g bis(2,4,6-trimethylbenzoyl)-phenyl-phosphine oxide and 2 g isopropyl-9H-thioxanthen-9-one followed by 0.2 g of IRGASTAB UV 10 obtained from Ciba Specialty Chemicals, followed lastly by 37.5 g Pigment Black 7 dispersion consisting 91.7 percent propoxylated neopentylglycol diacrylate, NIPEX 150 ex DeGussa and EFKA-7496. The rheology of the ink composition was measured and found to have viscosities of 8.2 mPas at 75° C. and $6.72\times10^5$ mPas at 30° C., and the storage modulus (G') of the ink at 30° C. was found to be 1117 pascals (Pa).

Example 2

For example, an ink composition for the present process may be selected, in embodiments, from a phase change Ink containing curable isocyanate-derived compounds and phase change inducing components as disclosed in U.S. Patent Application of Eniko Toma et al., Ser. No. 11,290,098, filed Nov. 30, 2005, referenced above, comprising as follows.

Synthesis of Bis[4-(vinyloxy)butyl] dodecanedioate

To a 1 liter, two neck flask equipped with a stir bar, argon inlet, and stopper was added dodecanedioic acid (10.0 grams, 43 mmol, obtained from Sigma-Aldrich, Milwaukee, Wis.), 1,4-butanediol vinyl ether (10.1 grams, 87 mmol, obtained from Sigma-Aldrich), 4-(dimethylamino)pyridine (1.07 gram, 8.8 mmol, obtained from Sigma-Aldrich), 1-hydroxybenzotriazole (1.18 gram, 8.7 mmol, obtained from Sigma-Aldrich) and methylene chloride (500 milliliters). The reaction mixture was cooled to 0° C. and 1-[3-(dimethylamino) propyl]-3-ethylcarbodiimide hydrochloride (16.6 grams, 87 mmol, obtained from Sigma-Aldrich) was added portionwise. The reaction mixture was stirred at 0° C. for 0.5 hour, followed by stirring at room temperature until the reaction was deemed complete by $^1$H NMR spectroscopy in DMSO-d6 (about 2 hours); the signal corresponding to the methylene protons alpha to the carbonyl groups of 1,12-dodecanedioc acid (4H, triplet at δ2.18) was consumed and was replaced by a triplet at δ2.27 (4H), corresponding to $[H_2C{=}CHO(CH_2)_4OOCCH_2(CH_2)_4]_2$. The reaction mixture was then concentrated in vacuo and the residue was dissolved in ethyl acetate (300 milliliters). The organic layer washed with saturated sodium bicarbonate (2×150 milliliters) and water (2×150 milliliters), dried over anhydrous sodium sulfate, filtered, and concentrated in vacuo. The crude product was recrystallized from methanol to afford 13.5 grams (73 percent yield) of a white solid (mp=42-43° C.). The product was believed to be of the formula

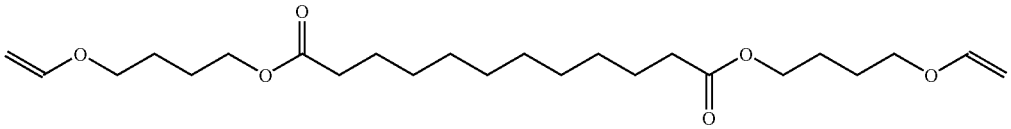

$^1$H NMR (300 MHz, $CDCl_3$): δ6.47 (2H, dd, J=14.3, 6.8 Hz), 4.19 (2H, dd, J=14.3, 1.9 Hz), 4.10 (4H, br. t, J=6.0 Hz), 4.00 (2H, dd, J=6.8, 1.9 Hz), 3.70 (4H, br. t, J=5.7 Hz), 2.29 (4H, t, J=7.5 Hz), 1.76-1.71 (8H, m), 1.63-1.56 (4H, m), 1.28 (12H, br. s).

Synthesis of Bis[4-(vinyloxy)butyl] trimethyl-1,6-hexanediylbiscarbamate (mixture of 2,2,4- and 2,4,4-isomers)

To a 2 liter three neck flask equipped with a stopper, dropping funnel, stir bar, and reflux condenser was added trimethyl-1,6-diisocyanatohexane (mixture of 2,2,4- and 2,4,4-isomers, 118.7 grams, 0.57 mol, obtained from Sigma-Aldrich, Milwaukee, Wis.), dibutyltin dilaurate (3.56 grams, 5.6 mmol, obtained from Sigma-Aldrich) and anhydrous tetrahydrofuran (1 liter). 1,4-Butanediol vinyl ether (133.2 grams, 1.2 mol, obtained from Sigma-Aldrich) was added slowly dropwise to the stirring solution via the addition funnel. The reaction mixture was brought to reflux and was kept at this temperature until deemed complete by infrared spectroscopy (about 5 hours, confirmed by the disappearance of the isocyanate peak at 2200 $cm^{-1}$). When the reaction was complete, methanol (500 milliliters) was added to quench any residual isocyanate and the solution was stirred for 0.5 hour. The solvent was stripped in vacuo and the residual oil was triturated with hexane (3×500 milliliters), dissolved in methylene chloride (1 liter), washed with water (1×750 milliliters), dried over anhydrous magnesium sulfate, filtered, and concentrated in vacuo to afford 221 grams of a pale yellow oil (89 percent yield). The product was believed to be a mixture of compounds of the formulae

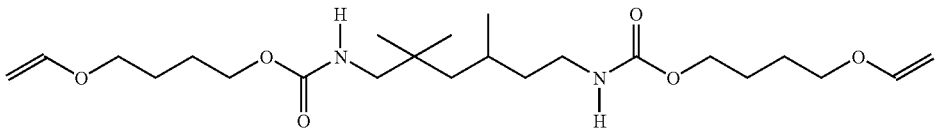

and

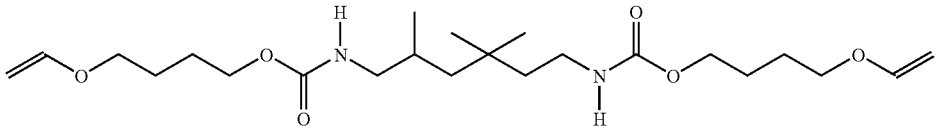

$^1$H NMR (300 MHz, $CDCl_3$): δ6.47 (2H, dd, J 14.3, 6.8 Hz), 4.88-4.62 (2H, br. m), 4.19 (2H, dd, J 14.3, 1.8 Hz), 4.09 (4H, br. s), 4.00 (2H, dd, J=6.8, 1.8 Hz), 3.70 (4H, br. s), 3.18-2.91 (4H, m), 1.72-1.01 (13H, m), 1.01-0.88 (9H, m).

Ink

To an aluminum pan was added 59.35 grams of bis[4-(vinyloxy)butyl] trimethyl-1,6-hexanediylbiscarbamate (mixture of 2,2,4- and 2,4,4-isomers, prepared as described above), 12.49 grams of bis[4-(vinyloxy)butyl] dodecanedioate (prepared as described above), 8.29 grams of R-GEN® BF-1172 (cationic photoinitiator; substituted triarylsulfonium hexafluorophosphate salt in propylene carbonate as a 40% solution; obtained from Chitec Chemical Co., Ltd., Taiwan, R.O.C.), 11.45 grams of VEctomer® 5015 (obtained from Sigma-Aldrich, Milwaukee, Wis.) and 12.50 grams of 1-octadecanol (obtained from Sigma-Aldrich). The mixture was heated with stirring at 100° C. until visually homogenous (about 1 hour). At this point, 0.94 grams of Neopen Blue 808 dye (obtained from BASF Aktiengesellschaft, Ludwigshafen, Germany) was added and the mixture was stirred with heating for an additional 1 hour.

In embodiments, controlling the viscosity of the ink during printing to match a selected characteristic of the final receiving substrate comprises controlling the viscosity of the ink to match a surface characteristic of the final receiving substrate, such as a gloss or matte characteristic. For example, in aspects of the present disclosure, in order to achieve temperature and hence media dependant viscosity changes, the rheology of the ink is selected to vary continuously over a wide temperature range. This type of rheology variance enables selection of ink viscosity by choosing the temperature required to achieve the selected viscosity. For example, with a cover stock, where drop spread might be an issue with low viscosity inks, the paper preheat temperature can be reduced, for example to about 30° C., where the ink viscosity is very high. The higher viscosity ink will still conform to the paper thus matching surface texture without excessive drop spread or paper show through. Whereas with a coated stock, the ink needs to have a viscosity where it can flow, or level, to provide a smooth surface that matches the smooth surface of the coated paper and so a higher paper preheat temperature can be selected. By these means a pleasing image appearance is achieved by matching or closely matching the ink image surface to that of the paper; thus, for example, controlling the viscosity of the ink during printing to achieve a matte image on rough textured uncoated papers or a glossy image on smooth coated papers.

For example, a selected receiving substrate characteristic, for example, paper type, or image properties (for example, matte or glossy) is determined for the print output. This may be done by operator intervention or automatically by the printer determining paper type. The latter may be done by measuring paper gauge, gloss, or reading imbedded information in the paper sheet. The paper temperature is adjusted according to the desired image properties. For example, higher temperatures can be selected for gloss, lower temperatures can be selected for matte. The actual temperature is selected based on the selected ink design and substrate (e.g., paper) type. In embodiments, the process includes modifying the temperature of the final receiving substrate to achieve a selected temperature. For example, modifying can be accomplished by heating or cooling. The temperature may be controlled, for example, by heated rollers, radiant heat sources, adjusting the temperature of these heat sources or the speed at which the paper passes through. Chilled rollers may also be used.

In one embodiment, the ink is jetted directly onto a final receiving substrate such as paper, including selecting an ink having a viscosity that varies continuously over the range of transfuse process temperatures; forming an image on the final receiving substrate with the selected ink; preheating the final receiving substrate; optionally passing the final receiving substrate through a nip; optionally fusing the ink image onto the final receiving substrate at a transfuse temperature; and controlling the viscosity of the ink during printing to match a selected characteristic of the final receiving substrate. In embodiments, the temperature of the ink at jetting, the image substrate temperature, and the heat transfer properties of the materials are selected to effect the desired image properties. In embodiments, the process comprises preserving the ink image morphology by curing the ink For example, the ink can be cured by means of light initiated polymerization, either radical or cationic, to make the selected characteristic in the image permanent.

In another embodiment, the ink is jetted on to a preliminary receiving substrate, such as an intermediate transfer member, and then transferred to the image receiving substrate by pressure. This embodiment comprises selecting an ink having a viscosity that varies continuously over the range of transfuse process temperatures; forming an image on a preliminary receiving surface with the selected ink; preheating a final receiving substrate; optionally passing the final receiving substrate through a nip; optionally exerting a pressure on the final receiving substrate in the nip to transfer the ink image from the preliminary receiving surface to the final receiving substrate; optionally fusing the ink image onto the final receiving substrate at a transfuse temperature; and controlling the viscosity of the ink during printing to match a selected characteristic of the final receiving substrate. In embodiments, the temperatures of the drum, the ink and receiving substrate are selected to effect the desired image properties. In embodiments, the process comprises preserving the ink image morphology by curing the ink. The ink may be cured, for example, by means of light initiated polymerization, either radical or cationic, to make the selected characteristic in the image permanent.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A process comprising:

selecting a gellant ink having a viscosity that varies continuously over a range of transfuse process temperatures;

providing a final receiving substrate at a selected temperature optionally including modifying the temperature of the final receiving substrate to achieve a selected temperature;

forming an image directly on the final receiving substrate with the selected ink;

controlling final image gloss or matte property by controlling the viscosity of the ink at the final receiving substrate during printing; and optionally preserving the ink image.

2. The process of claim 1, wherein selecting an ink comprises selecting an ink that is free of a sharp phase change transition characteristic and viscosity plateau at or near the transfuse temperature of the ink.

3. The process of claim 1, wherein controlling the viscosity of the ink during printing comprises adjusting one or a combination of the temperature of the ink at jetting, the preheat temperature of the final receiving substrate, the heat transfer properties of the ink, the heat transfer properties of the final receiving substrate, the temperature of the ink, and the temperature of the final receiving substrate during image formation.

4. The process of claim 1, wherein controlling the final image gloss or matte property comprises controlling the viscosity of the ink during printing by adjusting the temperature of the final receiving substrate to achieve a matte image.

5. The process of claim 1, wherein controlling the final image gloss or matte property comprises controlling the viscosity of the ink during printing by adjusting the temperature of the final receiving substrate to achieve a glossy image.

6. The process of claim 1, wherein the ink has a viscosity which changes from a first lower viscosity to a second higher viscosity on the final receiving substrate.

7. The process of claim 1, wherein the final receiving substrate comprises paper, box board, cardboard, plastic film, metal, ceramic, textile, or a combination thereof.

8. The process of claim 1, wherein preserving the ink image comprises curing the ink to render the selected image characteristics permanent; wherein curing comprises exposing the image to radiation selected from ultraviolet, visible, or electron beam wavelength radiation; optionally in the presence of photoinitiators, to effect polymerization of the ink.

9. The process of claim 1, wherein the final receiving substrate is an uncoated paper.

10. The process of claim 1, wherein the final receiving substrate is a coated paper.

* * * * *